US007052102B2

(12) United States Patent
Valero et al.

(10) Patent No.: US 7,052,102 B2
(45) Date of Patent: May 30, 2006

(54) DETECTING FIXER IN HARDCOPY APPARATUS

(75) Inventors: Jose Luis Valero, Barcelona (ES); Oscar Martinez, Castelldefels (ES)

(73) Assignee: Hewlett-Packard Development Company, L.P., Houston, TX (US)

( * ) Notice: Subject to any disclaimer, the term of this patent is extended or adjusted under 35 U.S.C. 154(b) by 121 days.

(21) Appl. No.: 10/629,780

(22) Filed: Jul. 30, 2003

(65) Prior Publication Data

US 2004/0125162 A1 Jul. 1, 2004

(30) Foreign Application Priority Data

Jul. 30, 2002 (GB) ..... 0217621

(51) Int. Cl.
*B41J 29/393* (2006.01)
*B41J 2/17* (2006.01)

(52) U.S. Cl. ..... 347/19; 347/98

(58) Field of Classification Search ..... 347/15, 347/19, 21, 40, 43, 37, 98, 95
See application file for complete search history.

(56) References Cited

U.S. PATENT DOCUMENTS

| | | | | |
|---|---|---|---|---|
| 4,907,013 | A * | 3/1990 | Hubbard et al. | 347/19 |
| 5,980,016 | A | 11/1999 | Nelson et al. | |
| 6,312,082 | B1 | 11/2001 | Lund et al. | |
| 6,378,976 | B1 | 4/2002 | Byers et al. | |
| 6,572,213 | B1 * | 6/2003 | Valero | 347/19 |
| 6,637,853 | B1 * | 10/2003 | Ahne et al. | 347/19 |
| 6,655,797 | B1 * | 12/2003 | Smith et al. | 347/98 |
| 2001/0038399 | A1 | 11/2001 | Lund et al. | |

* cited by examiner

*Primary Examiner*—Thinh Nguyen
(74) *Attorney, Agent, or Firm*—Foley & Lardner LLP

(57) ABSTRACT

Fixer is detected on a print media 22 by applying a predetermined pattern 200, FIG. 3, of fixer to the media, and over or under-printing it with a fill of coloured ink, and then optically detecting the predetermined pattern. For example, magenta ink may be applied over the fixer pattern on a glossy media, areas with both fixer and ink having a detectable increase in optical density compared to areas with ink alone. The pattern is scanned and the image information is used to check fixer nozzle functionality and fixer printhead alignment.

22 Claims, 3 Drawing Sheets

DETECTING FIXER IN HARDCOPY APPARATUS

The present invention relates to a method and device for detecting the presence of fixer in a hardcopy apparatus and especially to the detection of fixer when applied to a print media in an inkjet printer. It is desirable to be able to monitor that fixer is being correctly applied to a printed image since the absence of fixer from an image leads to a deterioration in optical density. It is particularly desirable to be able to detect whether an individual fixer nozzle of a fixer printhead is not working since the effect of this can be similar to that of a colour ink nozzle and can cause unwanted artefacts in the printed image. In addition, it is desirable to be able to check the alignment of the fixer printhead.

Arrangements are known, such as those disclosed in U.S. Pat. No. 5,600,350 and U.S. Pat. No. 5,796,414 for detecting patterns of ink printed on paper with a view to detecting nozzle or printhead misalignment. They include an optical sensing module which produces a signal permitting the correcting of image misregistration.

A problem with fixer is that, in itself, it is not optically detectable.

One known method of detecting fixer involves the incorporation into the fixer of a component which is detectable under infra-red radiation or under ultra-violet radiation. Infrared detection has the disadvantage of requiring a different type of detector from that used for the colour inks in the visible spectrum. Moreover, the infra-red or ultra-violet additives are expensive and reduce the quality of images produced with the use of the fixer; in particular said additives have the disadvantages of changing the visual aspect of the media where the fixer is present. For example, since ambient light and other light sources can include infra-red and ultra-violet components, the fluorescence effect causes the printed image to have a different colour balance under differing lighting conditions. Thus the presence of an additive which fluoresces under ultra-violet light can cause the printed image to have a blue tinge.

U.S. Pat. No. 5,980,016 discloses an arrangement for detecting an otherwise invisible ink by printing a fractional fill pattern in a normal ink and then superimposing calibration indicia or another pattern in the "invisible" ink. Bleeding between the two inks converts the fractional fill into a more solid fill so that the locations can be identified where the "invisible" ink was applied. A disadvantage of this arrangement is that it is not possible to detect individual nozzles or relatively small numbers of nozzles but only groups of a relatively high number of nozzles. Also, the fact that bleeding is detected imposes the requirement that the two inks are applied with only a short delay therebetween.

Certain aspects of the present invention seek to overcome or reduce one or more of the above disadvantages. They also seek to enable individual fixer nozzles which are defective to be detected so that their effects can be hidden by adopting modified fixer application methods. Such methods employ algorithms similar to those known for normal ink nozzles to preserve acceptable print quality. Certain aspects of the invention seek to permit the detection of fixer for nozzle and printhead alignment purposes. This can be implemented either when setting up a hardcopy device or when replacing a printhead.

According to a first aspect of the present invention, there is provided a method of detecting fixer on a print media comprising the steps of:

(i) applying fixer in a predetermined pattern to a region of the media;

(ii) before or after the application of the fixer, applying ink to said region of the media whereby the locations where both fixer and ink are present are optically distinguishable from the locations where only ink is present; and (iii) optically detecting the predetermined pattern.

Preferably the predetermined pattern comprises a plurality of parallel lines arranged in columns, each line being applied by a respective fixer nozzle, with immediately adjacent nozzles being arranged to print lines in adjacent columns and immediately adjacent lines in the same column being arranged to be printed by nozzles which are separated by n further nozzles, wherein n is an integer. Such a pattern enables unambiguous detection of the lines. The integer n preferably lies between two and eight and is most preferably equal to four.

According to a second aspect of the present invention, there is provided an apparatus for detecting fixer on a print media comprising a fixer printhead, said printhead being arranged to apply fixer in a predetermined pattern to a region of a print media, an ink printhead, said ink printhead being arranged to over- or under-print ink on said region of the media, and an optical detector, said optical detector being arranged to optically detect said predetermined pattern.

Said optical detector may be a line detector of a type which is already present to serve other functions in hardcopy devices.

Certain aspects of the present invention seek to provide a hardcopy device in which the need is avoided to have a different detection process for the fixer than for the coloured inks.

According to a third aspect of the present invention there is provided a hardcopy device including apparatus according to the second aspect and comprising first nozzles, said first nozzles being arranged to apply fixer to a print media, and second nozzles, said second nozzles being arranged to apply one or more coloured inks to the print media, wherein a common, or a similar, optical detector and/or processor is used to check the operation and/or alignment of said first and second nozzles.

As used herein, the term "ink" includes coloured inks and also other liquids which are printed on print media, such as liquids including biological specimens.

A fixer is a liquid applied to print media to fix another liquid on the media, i.e. to restrict the spreading of the other liquid through the print media from the location where the other liquid is originally applied. Thus a fixer can be regarded as a substance which changes the properties of the print media. When applied, fixer alone should not be visible optically since this would adversely effect printing quality.

The expression "hardcopy device" embraces all types of apparatus which apply indicia to print media and embraces all types of printers, photocopiers, facsimile machines and scanners.

Preferred embodiments of the present invention will now be described, by way of example only, with reference to the accompanying drawings, of which:

Figure 3:
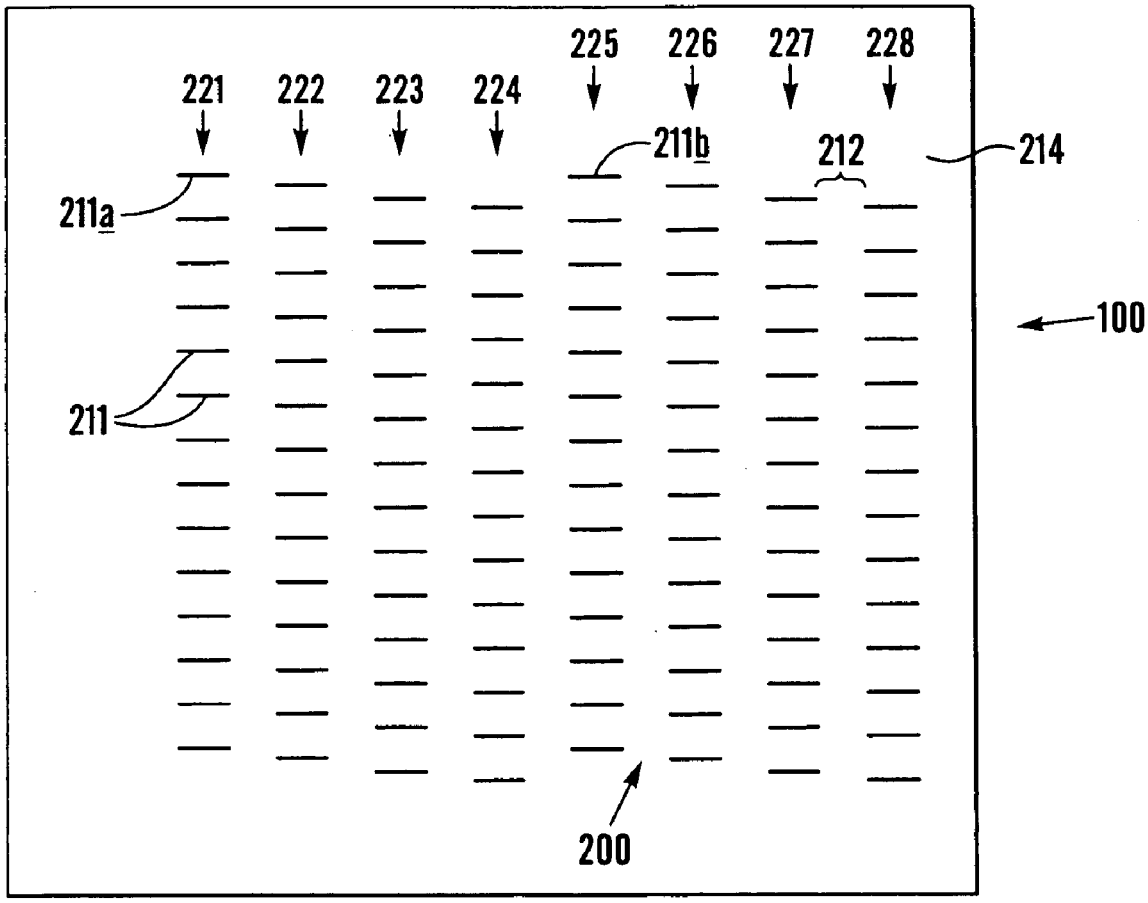
Figure 4:
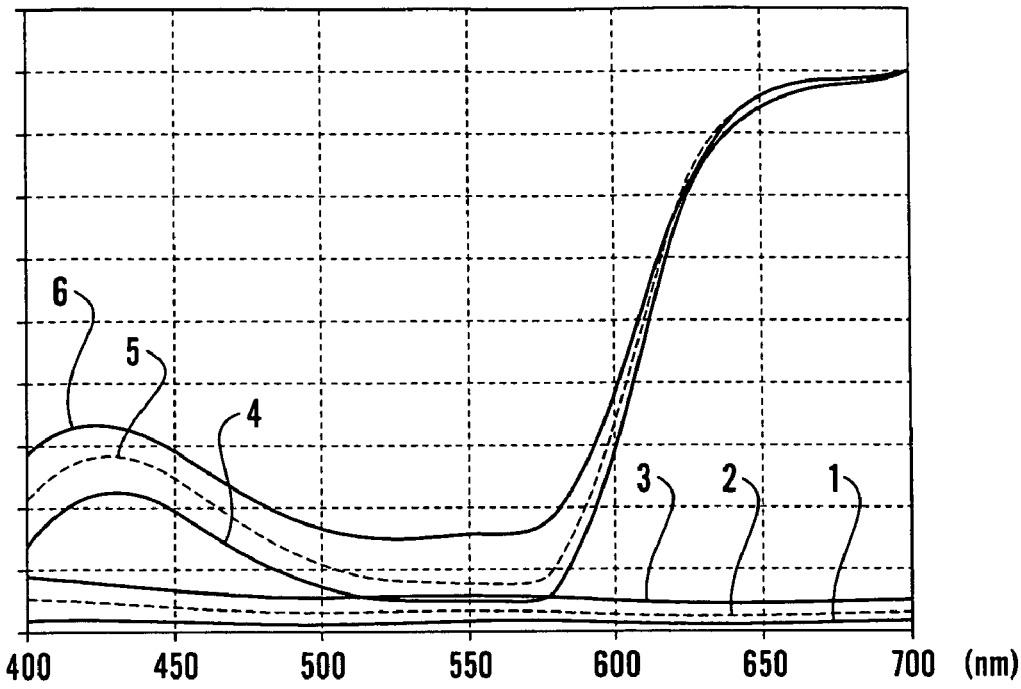
Figure 5:
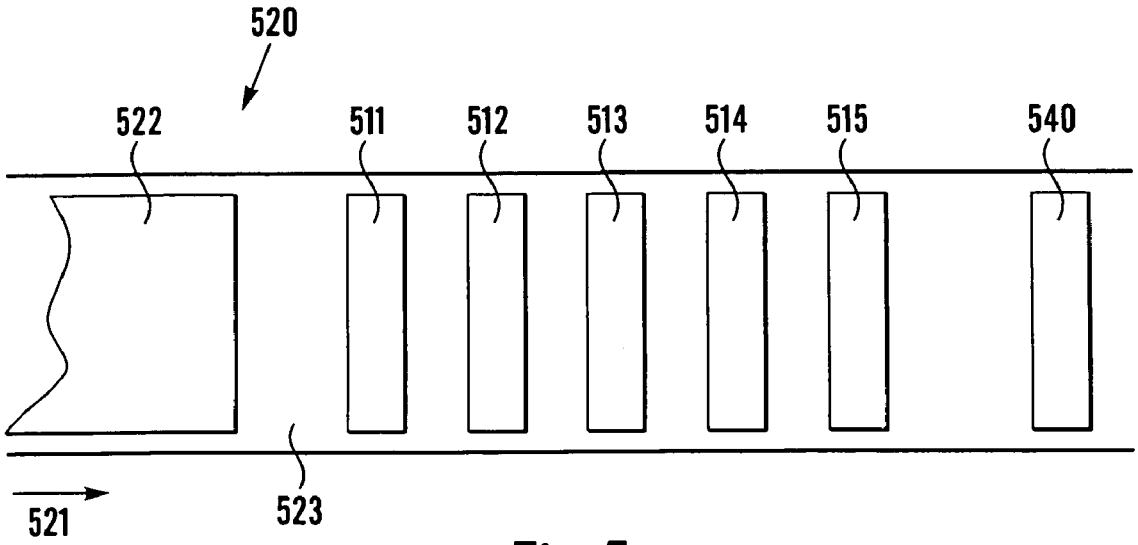

FIG. 3 schematically shows a test printing used in a preferred embodiment of the present invention; and FIG. 4 shows, for a glossy media, the curves measured by a spectrophotometer of reflectance against incident light wavelength for various inks and combinations of ink and fixer used in embodiments of the present invention; and FIG. 5 is a top plan view of components of a page-wide array (PWA) printer as used in preferred embodiments of the present invention.

Figure 1:
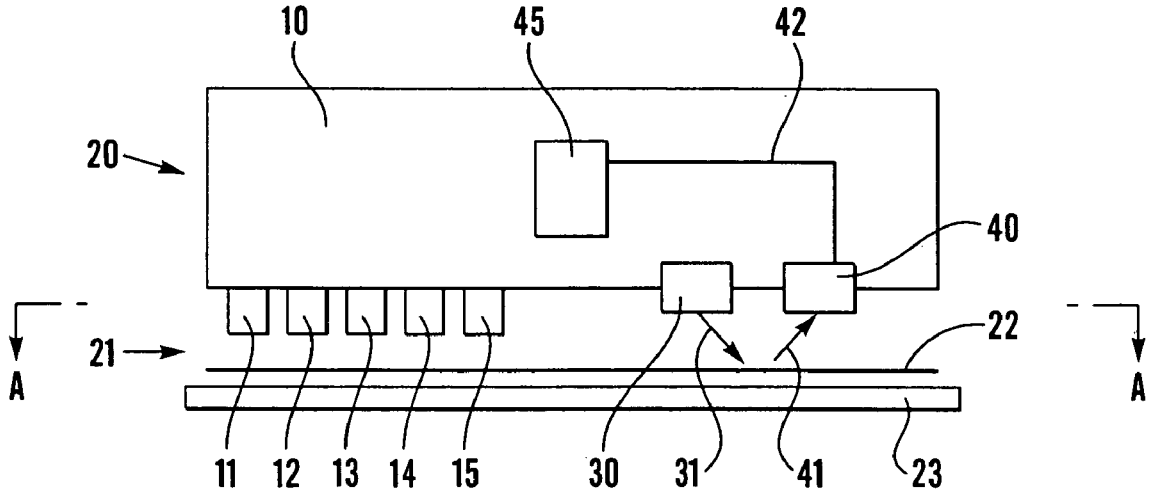
FIG. 1 shows a side view of components of an ink-jet printer with a printhead carriage and as used in preferred embodiments of the present invention.
Figure 2:
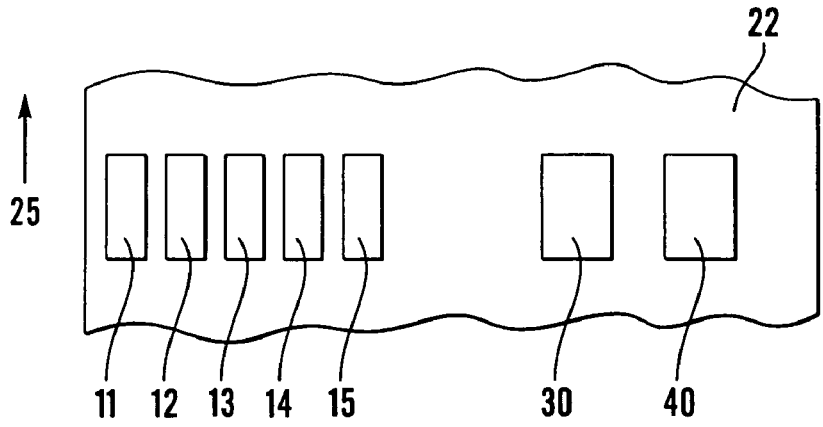
FIG. 2 is a top plan view of some of the components of the printer of FIG. 1.

Referring to the drawings, FIG. 1, shows a side view of the printhead carriage 10 of an inkjet printer indicated schematically at 20. FIG. 2 shows a top view taken along the line A—A of FIG. 1. The carriage 10 is caused to move forwards and backwards in a scanning direction indicated by arrow 21 in FIG. 1 over a print media 22. Between scans by the carriage 10, the print media 22 is advanced over a fixed platen 23 of the printer in a media advance direction indicated by arrow 25 of the FIG. 2. The carriage 10 carries five printheads 11, 12, 13, 14, 15 each comprising sets of nozzles respectively firing cyan, magenta, yellow and black inks and fixer liquid on to the print media during the scans of the carriage 10. Also mounted on carriage 10 is a source 30 of visible radiation 30. Source 30 directs radiation 31 at the print media 22. A detector 40 of light 41 reflected from media 22 is also mounted on carriage 10.

In a preferred embodiment of the present invention a test printing 100, FIG. 3, comprises two stages. Firstly, a test pattern 200 is printed in a fixer on a lustro glossy offset paper media, and secondly an area fill 214 of ink is printed over the same region.

The test pattern 200 comprises eight columns 221 to 228 each comprising seventy two individual lines 211. Each line 211 is printed by a single nozzle of a fixer printhead and has a length corresponding to five pixels. The gap 212 between the columns corresponds to four pixels. The top lines in columns 221 and 225 are aligned with each other and are printed by the same nozzle, as are subsequent lines in these columns. The same applies to the corresponding lines in columns 222 and 226, the lines in columns 223 and 227 and the lines in columns 224 and 228. Thus, counting the nozzles from one end of the fixer printhead, successive lines down both columns 221 and 225 are printed by the first, fifth, ninth and every successive fourth nozzle. Similarly successive lines down both columns 222 and 226 are printed by the second, sixth, tenth and every successive fourth nozzle. Similarly the third, seventh and eleventh etc. nozzles print the lines in both columns 223 and 227, and the fourth, eighth and twelfth etc. nozzles print the lines in both columns 224 and 228.

Approximately 30 seconds after printing the fixer test pattern 200, magenta ink is printed over the fixer. A ratio of magenta to fixer of 1:1 by volume is employed.

At the locations of the lines 211 of fixer, the optical density of the magenta colour is detectably higher than locations where only magenta ink is printed. Thus by measuring the local reflectance or reflectivity of the media, the presence of the fixer can be detected. This is done by scanning the media to detect the fixer pattern with a detector 40 such as a 600 dpi scanner. Relative movement between the scanner and the lines 211 on the media occur in a direction along the lines or perpendicular to the lines and the detector 40 produces image signals 42. Signals 42 are supplied to processing circuitry 45, in which they are processed using image processing algorithms to monitor individual fixer nozzles. The reflectance of the combination of fixer under magenta ink is shown by curve 6 in FIG. 4, wherein curve 4 represents the reflectance of magenta ink alone.

An advantage of the above-described arrangement is that the same detecting equipment and processing hardware and software can be employed to detect fixer as are used to detect an optically detectable coloured ink. There is no need for special illumination or special additives. This permits rationalisation in a hardcopy device using the method since the same, or similar, detection and processing means may be used to monitor the fixer nozzles as the colour ink nozzles.

Furthermore, since the method does not rely on bleeding, there is no need for the fixer and ink to be applied within a short period of time. The method can be used with fine patterns and is sufficiently accurate to detect the performance of individual nozzles. Moreover, it allows the same apparatus to monitor both correct fixer nozzle operation and the alignment of the fixer printhead.

For accurate detection of lines 211 by the scanner 40, there should be a clear separation between each line and its immediate neighbours in each direction. Accordingly, it is advantageous to print the lines 211 in the staggered arrangement of columns 221 to 224.

Arranging for each fixer nozzle to print two lines e.g. 211*a* and 211*b* of the pattern 200 serves as an extra check of correct operation. In certain circumstances, the performance of a nozzle can change relatively quickly over time as fixer is discharged which has been located in the nozzle for a period of time; the composition of the fixer may change as it dries out. Printing two lines with each nozzle permits compensation to be made for the effects of these temporary changes.

Various modifications can be made to the above-described arrangement.

For example, the fixer can be applied after the magenta ink. In this case the reflectance is shown by curve 5 in FIG. 2; as will be noted, the contrast with magenta ink alone, curve 4, is less than for the above-described "fixer under" arrangement. Accordingly, it is preferred to print the fixer pattern first.

Instead of magenta coloured ink, black ink can alternatively be used. Curve 3 in FIG. 4 represents fixer under black ink, curve 2 represents fixer over black ink and curve 1 represents black ink alone. It will be noted that the contrast of reflectances is generally lower than for magenta coloured ink.

Inks of other colours can also be employed, but generally do not provide as good a contrast as magenta.

Different print media may also be employed. For example with a type of media known as bond paper, it is found that the most noticeable differences are obtained with fixer under black ink.

Detector 40 may be capable of detecting reflected ambient light, in which case light source 30 can be omitted.

Various ink/fixer ratios may be employed between 3 to 1 and 1 to 5 by volume of applied ink and fixer respectively. Preferred ratios lie within the range ink/fixer between 2 to 1 and 1 to 2.

The fixer and ink can be applied within a time period from a few milliseconds (corresponding to the fixer and ink being applied in the same printing pass) to 30 sec. or over. If for a particular media, bleeding between the fixer and the ink used is a problem, a relatively high delay period is chosen to allow the first applied liquid to dry to a desired extent. There is no need for conductive or convective drying. For glossy offset media, bleeding is more visible for magenta ink than cyan or black. For the types of plain paper tested, a negligible amount of bleed occurs, even when the fixer and ink are applied in the same printing pass.

Since the pattern of FIG. 3 consists of lines 211 printed by respective individual nozzles, it can be used to detect individual nozzles "out", i.e., not functioning. Other patterns can be used.

For example, the lines 211 may be longer or shorter than five pixels, though a length of at least three pixels is preferred. The gap 212 between columns may be longer or shorter than four pixels. The distance between lines 211 in a single column may be larger or smaller than four line spaces; as the distance increases, the number of columns corresponding increases. Each nozzle may be used to print only a single line; this halves the number of columns shown in FIG. 3. Alternatively, each nozzle may be used to print more than two lines, in which case the total number of columns correspondingly increases.

The printing order in time of the nozzles of the fixer printhead may be altered. Thus instead of the first four nozzles firing once each in succession and then once each again in succession, the first nozzle may fire twice followed by the second nozzle firing twice and then, the third nozzle firing twice and the fourth nozzle firing twice.

Instead of lines, dots may be printed using individual drops of fixer. However this is a less robust method since it has a lower signal to noise ratio. Another advantage of firing more than one drop per nozzle is that the first drop can be weak or even completely missing, for example if the nozzle has dried a little.

Instead of lines 211 having the thickness of a single dot or nozzle, wider areas of fixer may be produced on the print media. Thus adjacent fixer nozzles may be fired simultaneously to obtain a solid area full of fixer. Alternatively, appropriate relative movement of a fixer nozzle relative to the print media in reciprocating manner can be used so that a single nozzle prints two or more directly adjacent lines to provide a suitable area fill for detection.

The fill area may have a square, rectangular or other shape.

In all cases, the application of an edge detection algorithm to a scanned image facilitates the identification of the effects of different fixer nozzles.

Instead of directly detecting the difference in reflectivities of portions of the print media where fixer has been applied and has not been applied, the lines 211 or other shapes can be detected by comparing their reflectivity with a value stored in a look-up table. The look-up table may store reflectivity values corresponding to the absence of fixer, in which case the comparison indicates the presence of fixer when the signal detected by the scanner lies above a predetermined threshold. Alternatively, the look-up table may store reflectively values corresponding to the presence of fixer, in which case the comparison indicates the present of fixer when the signal detected by the scanner lies below a predetermined threshold. The look-up table may store reflectivity values corresponding to combinations of different inks, different fixers and different print media.

Instead of a printer comprising a movable printhead carriage 10, embodiments of the present invention may be used in a page wide array printer with fixed printheads. Such an arrangement is shown in FIG. 5 in which a printer indicated schematically at 520 comprises a platen 523 over which a print media 522 advances in the direction indicated by arrow 521. The media passes below fixed printheads 511, 512, 513, 514 and 515 each comprising sets of nozzles respectively firing cyan, magenta, yellow and black inks and fixer liquid on to the print media. A line scanner 540 is used to check where ink or ink and fixer have been applied to the print media 22.

What is claimed is:

1. A method of detecting fixer on a print media comprising the steps of:

(i) using a fixer printhead comprising a plurality of fixer nozzles to apply fixer in a predetermined pattern comprising a plurality of spaced parallel lines to a region of the media, each line being applied by a respective fixer nozzle;

(ii) before or after the application of the fixer, applying ink to said region of the media whereby the locations where both fixer and ink are present are optically distinguishable from the locations where only ink is present; and (iii) optically detecting the predetermined pattern.

2. A method according to claim 1, wherein the parallel lines are arranged in columns, immediately adjacent nozzles being arranged to print lines in adjacent columns and immediately adjacent lines in the same column being arranged to be printed by nozzles which are separated by n further nozzles, wherein n is an integer.

3. A method according to claim 2, wherein n is 3.

4. A method according to claim 1, wherein the period is selected such that bleeding of the fixer and ink substantially does not occur.

5. A method according to claim 1, wherein the steps of applying fixer and ink to said region occur within a period of thirty seconds or less.

6. A method according to claim 5, wherein the period is selected such that bleeding of the fixer and ink substantially does not occur.

7. A method according to claim 1, wherein the ink and fixer are applied to the media in an ink/fixer ratio between 2 to 1 and 1 to 2 by volume.

8. A method according to claim 1, wherein the ink is magenta coloured ink and the media is glossy.

9. A method according to claim 1, wherein the ink is black and the media is plain or bond.

10. A method according to claim 1, further comprising:

(iv) determining performance of each of the plurality of fixer nozzles based on the predetermined pattern detected in step (iii).

11. A method of detecting fixer on a print media comprising the steps of:

(i) applying fixer in a predetermined pattern to a region of the media;

(ii) before or after the application of the fixer, applying ink to said region of the media whereby the locations where both fixer and ink are present are optically distinguishable from the locations where only ink is present; and (iii) optically detecting the predetermined pattern, wherein said steps (i) and (ii) occur within a period such that bleeding of the fixer and ink substantially does not occur.

12. A method according to claim 11, wherein said steps (i) and (ii) occur within a period of thirty seconds or less.

13. A method according to claim 11, wherein the ink is magenta coloured ink and the media is glossy.

14. A method according to claim 11, wherein the ink is black and the media is plain or bond.

15. An apparatus for detecting fixer on a print media comprising a fixer printhead, said printhead comprising a plurality of fixer nozzles and being arranged to apply fixer in a plurality of spaced parallel lines to a region of a print media, each line being applied by a respective fixer nozzle, an ink printhead, said ink printhead being arranged to over- or under-print ink on said region of the media, and an optical detector, said optical detector being arranged to optically detect said parallel lines.

16. An apparatus according to claim 15, wherein said ink printhead comprises a plurality of ink nozzles, and wherein a common optical detector is used to check the operation of said fixer nozzles and said ink nozzles.

17. An apparatus according to claim 15, comprising a processor, said processor being connected to the optical detector and being arranged to check whether individual fixer nozzles are functioning correctly.

18. An apparatus according to claim 17, wherein said ink printhead comprises a plurality of ink nozzles, and wherein a common optical detector is used to check the operation of said fixer nozzles and said ink nozzles.

19. An apparatus according to claim 17, wherein said processor determines whether individual fixer nozzles are operating correctly based on a pattern of said parallel lines detected by said optical detector.

20. An apparatus according to claim 15, comprising a processor, said processor being connected to the optical detector and being arranged to check whether a fixer printhead is correctly aligned.

21. An apparatus according to claim 20, wherein said ink printhead comprises a plurality of ink nozzles, and wherein a common optical detector is used to check the alignment of said fixer nozzles and said ink nozzles.

22. An apparatus according to claim 15, wherein the optical detector is a line detector.

* * * * *